US010836411B2

(12) United States Patent
Kernwein et al.

(10) Patent No.: US 10,836,411 B2
(45) Date of Patent: Nov. 17, 2020

(54) METHOD AND APPARATUS TO VERIFY TRAIN INTEGRITY BY COMPARING HEAD OF TRAIN AND END OF TRAIN TELEMETRY

(71) Applicant: Westinghouse Air Brake Technologies Corporation, Wilmerding, PA (US)

(72) Inventors: Jeffrey D. Kernwein, Cedar Rapids, IA (US); Stephen Craven, Hiawatha, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 42 days.

(21) Appl. No.: 16/220,553

(22) Filed: Dec. 14, 2018

(65) Prior Publication Data

US 2020/0189630 A1 Jun. 18, 2020

(51) Int. Cl.
*B61L 15/00* (2006.01)

(52) U.S. Cl.
CPC ..... *B61L 15/0054* (2013.01); *B61L 15/0018* (2013.01)

(58) Field of Classification Search
CPC ..... B61L 15/0054; B61L 15/0018
See application file for complete search history.

(56) References Cited

U.S. PATENT DOCUMENTS 7,395,141 B1 * 7/2008 Seck ..... B61C 17/12 246/182 R
2006/0290478 A1 * 12/2006 Stull ..... B61L 15/0027 340/425.5

FOREIGN PATENT DOCUMENTS

EP 1600351 B1 * 1/2007 ..... B61K 9/12

* cited by examiner

*Primary Examiner* — Hunter B Lonsberry
*Assistant Examiner* — Elizabeth Yang
(74) *Attorney, Agent, or Firm* — Christopher R. Carroll; The Small Patent Law Group LLC

(57) ABSTRACT

Systems and methods of verifying train integrity may include generating EOT operation information based on sensor data from one or more sensors located at the end of a train, monitoring train integrity by periodically determining if the EOT operation information correlates to HOT operation information in a head of the train associated with a status of one or more sensors in the head of the train within a predetermined range, generating an integrity notification based at least partially on monitoring the predetermined range between EOT operation information and HOT operation information, and communicating a notification of an integrity event to at least one of the following: an on-board computer, an EOT device, a remote server associated with a specified entity, or any combination thereof.

18 Claims, 5 Drawing Sheets

METHOD AND APPARATUS TO VERIFY TRAIN INTEGRITY BY COMPARING HEAD OF TRAIN AND END OF TRAIN TELEMETRY

BACKGROUND

Field of the Invention

The present invention relates generally to systems and methods of verifying train integrity using operation information from an end of a train (EOT) and operation information from a head of a train (HOT), and, in particular, safety methods of notifying a train operator and/or train control systems of an integrity event.

Description of Related Art

There is a growing movement to transport more material by rail as production of goods reaches capacity. Additional and improved safety systems are required to solve problems in current systems. Thus, there are efforts to improve the safety of systems used to determine the health of a train, including end of train (EOT) devices. An EOT device is generally armed by a railway engineer to a head of train (HOT) device to provide a safe and reliable intra-train communication connection between the locomotive and the end of the train. In some non-limiting embodiments or aspects, the EOT device communicates train data to the HOT device via radio signals (e.g., RF signals, etc.) pertaining to the pressure in the brake pipe (e.g., brake pipe pressure, etc.) in the end of a train and motion data related to the end of the train railcar. For example, the EOT device includes a pressure transducer to monitor brake pipe pressure that is attached to a brake pipe that runs the length of the train and a motion sensor. The EOT device then uses RF communications to send data to the HOT device in the locomotive cab. In addition to getting data from the EOT device, the HOT device is coupled to sensors and determines train data at the head of the train.

Despite these efforts, the current HOT device and EOT device are not used and/or not accurately and efficiently used for verifying train integrity. Under normal circumstances, if a train comes apart, hoses (e.g., air valves) at each end of a railcar (e.g., angle cocks, etc.) that connect the brake pipe between railcars (e.g., a freight car, etc.) will separate and the brakes are then automatically applied.

However, when the air valves at either end of a freight car (e.g., angle cocks, etc.) are used (e.g., positioned, moved, etc.) to close off the brake pipe, either by accident or intentionally (e.g., with malicious intent, etc.), a safety condition can occur. Such events are becoming more frequent. When the air valves are closed, it is possible for one or more railcars of a train to be separated from the train and one another without causing a braking application. Under the wrong conditions, separating a rail car without a braking application can accompany disastrous consequences. For example, when the EOT device fails and/or does not otherwise send a brake pipe pressure (BPP) update, an unreported separation of a train can occur where a portion of the train separates. In present systems, this can occur without awareness by the operators in the locomotive or train control systems. In addition, without updates from a head of a train and an end of a train, the Positive Train Control (PTC) system may not be capable and/or configured to efficiently and/or safely determine the status of a train.

SUMMARY

In non-limiting embodiments or aspects, provided are systems and methods of verifying train integrity systems using operation information, computer-implemented methods of verifying train integrity, and computer program products for a train. Preferably, provided are improved systems, methods, and computer program products that overcome certain deficiencies and drawbacks associated with existing train integrity verification systems, methods, and computer program products.

In a non-limiting embodiment or aspect, provided is a computer-implemented method of verifying train integrity. The method may include generating EOT operation information based on sensor data from one or more sensors located at the end of a train, the EOT operation information associated with one or more operating conditions in at least one railcar at the end of the train; monitoring, at an on-board computer having one or more processors, train integrity by periodically determining if the EOT operation information correlates to HOT operation information in a head end of the train associated with a status of one or more sensors in the head of the train within a predetermined range; generating, by an on-board computer, an integrity notification based at least partially on monitoring the predetermined range between EOT operation information and operation information associated with a head of the train; and directly or indirectly communicating, by at least one communication device, a notification of an integrity event to at least one of the following: an on-board computer located in or associated with at least one locomotive of the train, an end of train computer located in or associated with at least one railcar of the train, a remote server associated with a specified entity, or any combination thereof.

In a non-limiting embodiment or aspect, provided is a train integrity verification method for avoiding a train integrity hazard. The method may include: sensing or determining an operating condition associated with an end of a train; sensing or determining an operating condition associated with a head of a train; monitoring train integrity by periodically determining an integrity range, the integrity range based on a difference between the operating condition associated with the end of a train and the operating condition in the head of the train; and generating an integrity alert based on monitoring an integrity range outside a threshold.

In another non-limiting embodiment or aspect, provided is a computer program product comprising at least one non-transitory computer-readable medium including program instructions that, when executed by at least one computer including at least one processor, causes the at least one computer to verify train integrity. The computer program product comprising at least one non-transitory computer-readable medium including program instructions that, when executed by at least one computer including at least one processor, causes the at least one computer to: generate EOT operation information based on sensor data from one or more sensors located at the end of a train, the EOT operation information associated with one or more operating conditions in at least one railcar at an end of the train; monitor train integrity by periodically determining if the EOT operation information correlates to HOT operation information in a head of the train associated with a status of one or more sensors in the head of the train within a predetermined range; generate an integrity notification based at least partially on monitoring the predetermined range between EOT operation information and operation information associated with a head of the train; and directly or indirectly communicate a notification of an integrity event to at least one of the following: an on-board computer located in or associated with at least one locomotive of the train, an end-of-train computer located in or associated with at least one railcar of the train, a remote server associated with a specified entity, or any combination thereof.

In a non-limiting embodiment or aspect, provided is a train integrity verification system. The train integrity verification system including: an EOT control unit in the last railcar of the train, the EOT control unit including a transceiver, a display, and one or more sensors configured to generate EOT operation information based on sensor data from the one or more sensors, the EOT operation information associated with one or more operating conditions at an end of the train; and a HOT control unit in a locomotive of the train, the HOT control unit including a display, wherein the EOT control unit and the HOT control unit are configured to communicate via one or more radios, the HOT control unit configured to monitor train integrity at a head of the train by periodically determining if the EOT operation information and HOT data associated with one or more operating conditions at the head of the train are within a predetermined range, wherein, if EOT operation information and HOT operation information are not within a predetermined range, the HOT control unit is programmed to automatically display an operator warning for notifying an operator of an issue with train integrity.

The present invention is neither limited to nor defined by the above summary. Rather, reference should be made to the claims for which protection is sought with consideration of equivalents thereto.

Further non-limiting embodiments or aspects will now be described in the following clauses:

Clause 1: A computer-implemented method of verifying train integrity using operation information from an end of a train and operation information from a head of a train, the method comprising: generating end of train (EOT) operation information based on sensor data from one or more sensors located at the end of the train, the EOT operation information associated with one or more operating conditions in at least one railcar at the end of the train; monitoring, at an on-board computer having one or more processors, train integrity by periodically determining if the EOT operation information correlates to head of train (HOT) operation information in the head of the train associated with a status of one or more sensors in the head of the train within a predetermined range; generating, by an on-board computer, an integrity notification based at least partially on monitoring the predetermined range between EOT operation information and HOT operation information; and directly or indirectly communicating, by at least one communication device, a notification of an integrity event to at least one of the following: an on-board computer located in or associated with at least one locomotive of the train, an EOT device located in or associated with at least one railcar of the train, a remote server associated with a specified entity, or any combination thereof.

Clause 2: The computer-implemented method according to clause 1, further comprising: determining a speed at both ends of the train; in response to determining the speed at both ends of the train, determining a disconnected portion of the train based on the speed at both ends of the train outside of the predetermined range; and automatically initiating an emergency application of one or more brakes for stopping the disconnected portion of the train.

Clause 3: The computer-implemented method according to clauses 1 and 2, further comprising: displaying at the head of the train, if outside the predetermined range, an operator warning associated with verifying an issue with train integrity.

Clause 4: The computer-implemented method according to clauses 1-3, wherein generating the EOT operation information, further comprises: determining if a speed of the train in at least one railcar at the end of the train and the speed of the train in the locomotive at the head of the train are equivalent or within a range after determining if a brake pipe pressure in the at least one railcar at the end of the train correlates to the brake pipe pressure in the head of the train.

Clause 5: The computer-implemented method according to clauses 1-4, further comprising: receiving or transmitting, by an EOT device, sensor data associated with at least one railcar at the end of the train, the sensor data from one or more sensors located at the end of the train, the one or more sensors indicating the status related to train control in at least one railcar at the end of the train.

Clause 6: The computer-implemented method according to clauses 1-5, wherein the operation information comprises a first operation characteristic and a second operation characteristic in the train, the first operation characteristic for detecting a false positive associated with the second operation characteristic.

Clause 7: The computer-implemented method according to clauses 1-6, wherein the first operation characteristic comprises train speed and the second operation characteristic comprises brake pipe pressure.

Clause 8: The computer-implemented method according to clauses 1-7, wherein the operation information includes a speed of the at least one railcar at the end of the train, the method further comprising: determining the speed of the at least one railcar at the end of the train; generating an average speed range over the predetermined period for the at least one railcar at the end of the train; determining an average speed associated with at least one of a railcar, a sensor, or a locomotive at the head of the train for the predetermined period; determining the at least one railcar at the end of the train and the locomotive are within the average speed range over the predetermined period; and determining to disable an emergency brake application based on the train traveling below a predetermined threshold speed.

Clause 9: The computer-implemented method according to clauses 1-8, wherein the at least one railcar at the end of the train includes a plurality of railcars at the end of the train traveling at the speed outside the range, including the speed of the locomotive over the predetermined period.

Clause 10: The computer-implemented method according to clauses 1-9, wherein the speed of the at least one railcar at the end of the train is based on a location of the at least one railcar at the end of the train.

Clause 11: A train integrity verification method for avoiding a train integrity hazard, the method comprising: sensing or determining an operating condition associated with an end of a train; sensing or determining the operating condition associated with a head of the train; monitoring train integrity by periodically correlating an integrity range, the integrity range based on a difference between information associated with the operating condition associated with the end of the train and information associated with the operating condition in the head of the train; and generating an operator warning based on monitoring the integrity range outside of a threshold.

Clause 12: The train integrity verification method according to clause 11, further comprising: displaying, to an operator interface in response to the operator warning, a plurality of actions associated with avoiding the train integrity hazard; receiving, with the operator interface, a selection of at least one of the plurality of actions; and issuing a command in response to the selection.

Clause 13: The train integrity verification method according to clauses 11 and 12, further comprising: displaying at the head of the train, if not within a predetermined range, the operator warning associated with verifying an issue with train integrity.

Clause 14: The train integrity verification method according to clauses 11-13, further comprising: receiving or transmitting, by an EOT device, sensor data associated with at least one railcar at the end of the train, the sensor data from one or more sensors located at the end of the train, the one or more sensors indicating a status related to train control in at least one railcar at the end of the train.

Clause 15: The train integrity verification method according to clauses 11-14, wherein the operating condition comprises a first operating condition and a second operating condition in the train, the first operating condition for detecting a false positive associated with the second operating condition.

Clause 16: The train integrity verification method according to clauses 11-15, wherein the first operating condition comprises train speed and the second operating condition comprises brake pipe pressure.

Clause 17: The train integrity verification method according to clauses 11-16, wherein the operating condition includes a speed of at least one railcar at the end of the train, the method further comprising: determining the speed of the at least one railcar at the end of the train; generating an average speed range over a predetermined period for the at least one railcar at the end of the train; determining an average speed associated with the at least one railcar at the end of the train, a sensor, or a locomotive at the head of the train for the predetermined period; determining the at least one railcar at the end of the train and the locomotive are within the average speed range over the predetermined period; and determining to disable an emergency brake application based on the train traveling below a predetermined threshold speed.

Clause 18: The train integrity verification method according to clauses 11-17, wherein the at least one railcar at the end of the train includes a plurality of railcars at the end of the train traveling at a speed outside the average speed range including the speed of the locomotive over the predetermined period, wherein the speed of the plurality of railcars at the end of the train comprises the speed of the at least one railcar at the end of the train.

Clause 19: A computer program product comprising at least one non-transitory computer-readable medium including program instructions that, when executed by at least one computer including at least one processor, causes the at least one computer to: generate EOT operation information based on sensor data from one or more sensors located at an end of a train, the EOT operation information associated with one or more operating conditions in at least one railcar at the end of the train; monitor train integrity by periodically determining if the EOT operation information correlates to HOT operation information in a head of the train associated with a status of one or more sensors in the head of the train within a predetermined range; generate an integrity notification based at least partially on monitoring the predetermined range between EOT operation information and HOT operation information; and directly or indirectly communicate a notification of an integrity event to at least one of the following: an on-board computer located in or associated with at least one locomotive of the train, an EOT device located in or associated with at least one railcar at the end of the train, a remote server associated with a specified entity, or any combination thereof.

Clause 20: The computer program product according to clause 19, further including program instructions that, when executed by the at least one computer including the at least one processor, causes the at least one computer to: determine a disconnected portion of the train based on air pressure and speed at both ends of the train; and in response to determining a speed of the disconnected portion of the train within the predetermined range, automatically initiate an emergency application of one or more brakes for stopping the disconnected portion of the train.

DETAILED DESCRIPTION

Figure 1:
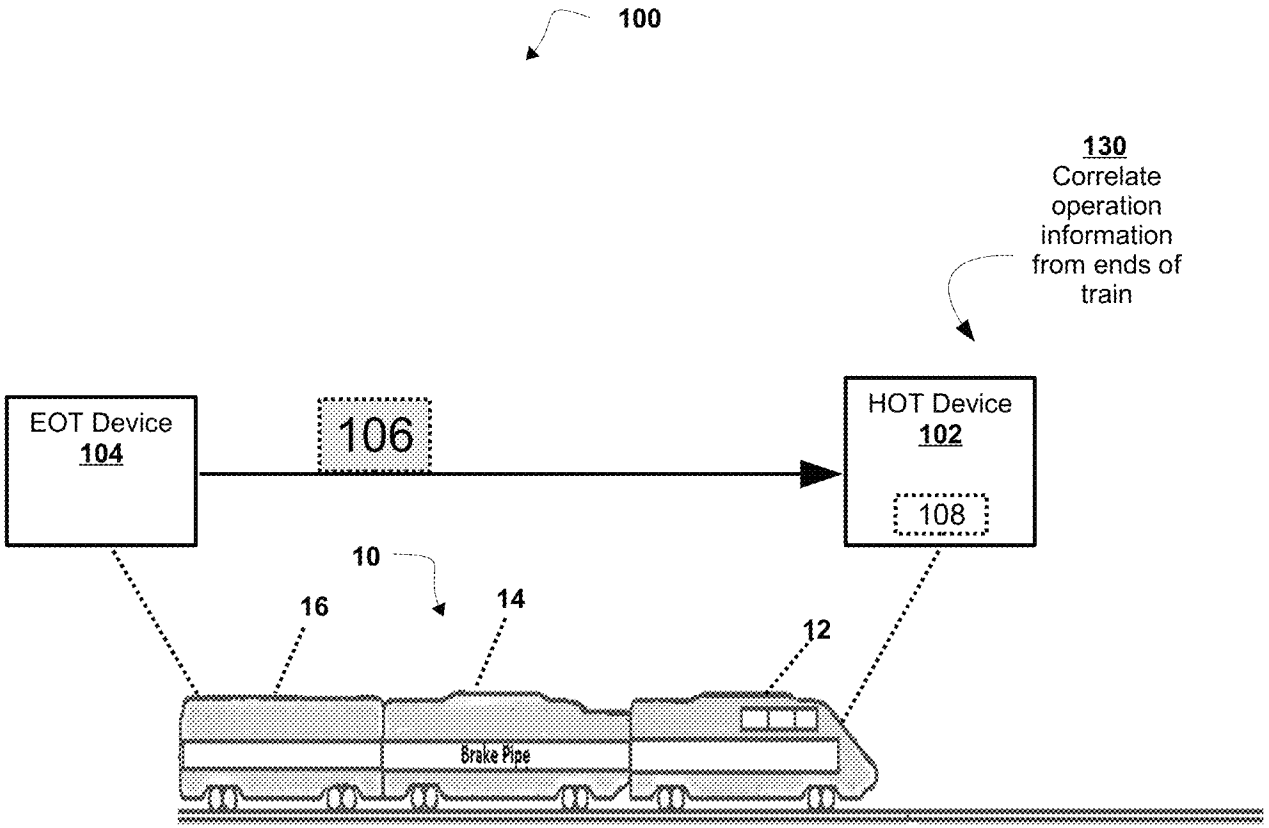
FIG. 1 illustrates a train with systems and methods of verifying train integrity using operation information from an end of a train and a head of a train according to a non-limiting embodiment or aspect.

As disclosed herein, in a non-limiting embodiment or aspect, a computer-implemented train integrity verification method may include generating end of train (EOT) operation information based on sensor data from one or more sensors located at the end of a train, the EOT operation information associated with one or more operating conditions in at least one railcar at the end of the train, monitoring, at an on-board computer having one or more processors, train integrity by periodically determining if the EOT operation information correlates to head of train (HOT) operation information in a head of the train associated with a status of one or more sensors in the head of the train within a predetermined range, generating, by an on-board computer, an integrity notification based at least partially on monitoring the predetermined range between EOT operation information and HOT operation information, and directly or indirectly communicating, by at least one communication device, the integrity notification associated with an integrity event to at least one of the following: an on-board computer located in or associated with at least one locomotive of the train, an EOT computer located in or associated with at least one railcar at the end of the train, a remote server associated with a specified entity, or any combination thereof.

In this way, a train integrity verification method includes receiving operation information from an end of train and operation information from a head of train for determining train integrity via an intra-train communication link between a HOT device and an EOT device. Accordingly, the train integrity verification method reduces or eliminates a processing delay associated with not alerting a train operator when a train integrity issue occurs (e.g., not alerting and/or not efficiently or accurately alerting an operator based on train integrity). Additionally, and/or alternatively, the train integrity verification method includes comparing timely indications of operation data (e.g., operation data about a head end of a train and/or an end of a train, etc.) to efficiently and/or safely alert a train operator and/or train control system. In addition, the train integrity verification method is capable and/or configured to efficiently and/or safely monitor operating conditions associated with determining train integrity in a head of a train.

It is to be understood that the invention may assume various alternative variations and step sequences, except where expressly specified to the contrary. It is also to be understood that the specific products, systems, and processes illustrated in the attached drawings, and described in the following specification, are simply exemplary embodiments of the invention. Hence, specific dimensions and other physical characteristics related to the embodiments disclosed herein are not to be considered as limiting. As used herein, the singular forms of "a," "an," and "the" include plural referents unless the context clearly dictates otherwise.

As used herein, the terms "communication" and "communicate" refer to the receipt, transmission, or transfer of one or more signals, messages, commands, or other types of data. For one unit or device to be in communication with another unit or device means that the one unit or device is able to receive data from and/or transmit data to the other unit or device. A communication may use a direct or indirect connection and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), private wireless, public wireless, 160/220/900 MHz VHF, Wi-Fi, UHF 452-458 MHz, WiMAX, Cellular 3G/4G/5G, omni-directional, and/or the like.

Referring now to FIG. 1, FIG. 1 is a diagram of a non-limiting embodiment of a train integrity verification system 100 in which systems and/or methods, described herein, can be implemented. As shown in FIG. 1, in a non-limiting embodiment or aspect, train 10 includes a locomotive 12, one or more railcars 14, and an end of train railcar 16. Systems and/or devices of train integrity verification system 100 can interconnect via wired connections, wireless connections, or a combination of wired and wireless connections.

With continued reference to FIG. 1, a non-limiting embodiment or aspect of a train integrity verification system 100 may include a HOT device 102 (e.g., a locomotive control unit (LCU), head of train unit, etc.) located in or associated with the locomotive 12 of the train 10. In some non-limiting embodiments or aspects, the HOT device 102 is mounted to the train operator's console in the locomotive 12. In a non-limiting embodiment or aspect, the HOT device 102 may be connected to an EOT device 104 (e.g., radio telemetry systems, end of train unit, etc.) on a railcar 14, typically the end of train railcar 16, in the train 10. For example, the EOT device 104 (e.g., EOT computer, etc.) is mounted to the end of train railcar 16 and coupled to the brake pipe by means of a hose and a glad hand. For example, in some non-limiting embodiments or aspects, the EOT device 104 generates EOT operation information based on sensor data from one or more sensors located at the end of a train, the EOT operation information associated with one or more operating conditions in at least one railcar 14 at the end of the train 10 or end of train railcar 16.

In a non-limiting embodiment or aspect, HOT device 102 includes a positioning (e.g., navigation, mapping, etc.) system (e.g., a global positioning (GPS) receiver and antenna, at least one wheel tachometer/speed sensor, magnetic compass for orientation, and/or the like). In some non-limiting embodiments or aspects, the positioning system in the HOT device 102 may be programmed to determine a speed measurement (e.g., to replace, or in conjunction with, a wheel tachometer, etc.). In some non-limiting embodiments or aspects, HOT device 102 may receive messages including positioning and or velocity information from an on-board computer and/or a remote server (e.g., a dispatch server, central office, etc.).

In some non-limiting embodiments or aspects, the HOT device 102 receives (e.g., via radio signals, etc.) data pertaining to an amount of pressure in a brake pipe, a position associated with an end of train railcar 16, and/or velocity of the end of train railcar 16. For example, in some non-limiting embodiments or aspects, the locomotive 12 (e.g., the HOT device 102), includes a receiver to receive transmissions from the EOT device 104, a primary display, and a microprocessor unit to direct the operation of these components.

With continued reference to FIG. 1, as shown by reference number 130, in a non-limiting embodiment or aspect, a train integrity verification system 100 includes correlating EOT data 106 from the EOT device 104 with HOT data 108 from the HOT device 102. For example, in some non-limiting embodiments or aspects, HOT device 102 receives EOT data 106 from the EOT device 104, including at least one of velocity or brake pipe pressure, and compares it with corresponding HOT data 108 from the locomotive 12 to verify an integrity of the train 10. In some non-limiting embodiments or aspects, HOT device 102 compares velocity data from the EOT device 104 with corresponding velocity data from the locomotive 12 to verify an integrity of the train 10.

In a non-limiting embodiment or aspect, HOT device 102 compares EOT data 106 with HOT data 108 to determine a correlation between air pressure associated with a head of the train (e.g., a locomotive 12, etc.) and an air pressure associated with an end of the train (e.g., end of train railcar 16). In some non-limiting embodiments or aspects, HOT device 102 determines a correlation between EOT data 106 and HOT data 108 despite a mismatch between air pressure in the front of the train and the rear of the train. For example, HOT device 102 determines a correlation of air pressure that accounts for air pressure characteristics in the brake pipe of the train 10 during normal operation, including variations such as small air pressure drops in the brake pipe throughout the train from leakage and/or delays in air propagation between the front air pressure and rear air pressure (e.g., HOT device 102 accounts for air propagation delays whenever the brake pipe is adjusted at the front, etc.).

In a non-limiting embodiment or aspect, HOT device 102 correlates by applying a model for predicting an air pressure. For example, HOT device 102 correlates by applying an air propagation model to determine an expected (e.g., proper, etc.) air pressure based on conditions in the train (e.g., at a head of the train, at an end of the train, along the railcars of the train, etc.). In some non-limiting embodiments or aspects, for example, HOT device 102 includes a model for predicting an EOT pressure based on a function of time and HOT pressure.

In some non-limiting embodiments or aspects, HOT device 102 may determine an air propagation delay between the EOT data 106 and the HOT data 108 that may not be caused by an expected air pressure during normal operation. For example, HOT device 102 compares EOT data 106 and the HOT data 108 and determines a leakage and/or obstruction may exist. For example, in some non-limiting embodiments or aspects, the locomotive 12 (e.g., the HOT device 102), includes a receiver to receive transmissions from the EOT device 104, a primary display, and a microprocessor unit to direct the operation of these components.

In a non-limiting embodiment or aspect, the HOT device 102 has a primary display panel which features a dedicated display for each of several types of end of train railcar 16 data. In some non-limiting embodiments or aspects, HOT device 102 displays EOT data 106, including information associated with a correlation of brake pipe pressure between the EOT device 104 and the HOT device 102, a correlation of position between the EOT device 104 and the HOT device 102, and/or a correlation of velocity between the EOT device 104 and the HOT device 102. In addition, HOT device 102 displays information about a low battery condition, whether the railcar 14 is stopped or in motion, and/or a status of an emergency action (e.g., a visual representation indicating whether an action had been enabled, disabled, detected, verified, responded to, etc.). The HOT device 102 also has a supplemental message display by which it visually conveys additional information such as, for example, data related to arming of the EOT system and whether or not the EOT device 104 and HOT device 102 are communicating properly.

In a non-limiting embodiment or aspect, a Service Interface Unit (SIU) connects between the serial port of the HOT device 102 and the brake pipe on the locomotive. The SIU provides the HOT device 102 with the current brake pipe pressure. In some non-limiting embodiments or aspects, the HOT device 102 automatically initiates a service brake application at the end of train railcar 16 simultaneously with the service reduction in brake pipe pressure initiated from the locomotive 12. For example, the HOT device 102 in the locomotive 12 automatically transmits a service brake radio signal to the EOT device 104 when it detects a service reduction in brake pipe pressure via the SIU.

In a non-limiting embodiment or aspect, the HOT device 102 continuously updates the train operator with the status of operations based on comparing a status at the rear of the train with a status at the front of a train. By way of example, in some non-limiting embodiments or aspects, the HOT device 102 continuously monitors a brake pipe pressure from the HOT device 102 and an EOT device 104. In some non-limiting embodiments or aspects, the HOT device 102 continuously monitors a brake pipe pressure from the HOT device 102 and an EOT device 104, and, if a potentially dangerous situation arises such as the brake pipe pressure differs or suddenly drops below a predetermined threshold, the HOT device 102 operates to warn the train operator that an emergency condition exists at the end of the train railcar 16.

In a non-limiting embodiment or aspect, HOT device 102 determines pressure input and the continuity of the brake pipe of a train 10 to be verified. In some non-limiting embodiments or aspects, HOT device 102 detects obstructions in the brake-pipe (e.g., closed angle cocks, kinks, blockages, breaks, etc.) that adversely affect brake safety. If the brake pipe is intact and/or unobstructed, a brake application initiated from the locomotive 12 should correspondingly result in a drop in pressure at the EOT device 104. The time required for the drop to propagate through the train 10 is a function of train length. If a pressure drop is not sensed at the EOT device 104 within a predetermined period of time, it is assumed to be due to either an obstructed brake pipe or a communications failure between the HOT device 102 and EOT device 104. In some non-limiting embodiments or aspects, the HOT device 102 initiates an integrity check for verifying train integrity by interrogating the EOT device 104 from the HOT device 102. In some non-limiting embodiments or aspects, HOT device 102 activates an alarm to warn the engineer of a communications failure.

In a non-limiting embodiment or aspect, the EOT device 104 generates EOT operation information including a first operational characteristic and second operational characteristic in the train 10 (e.g., a portion of the train 10, one or more portions, etc.).

In a non-limiting embodiment or aspect, EOT device 104 generates EOT operation information including the first operation characteristic for detecting a false positive associated with the second operation characteristic. For example, in some non-limiting embodiments or aspects, a speed operation characteristic is determined for verifying a brake pipe pressure operation characteristic. For example, HOT device 102, after determining a brake pipe pressure integrity condition, determines a speed operation characteristic to verify train integrity in accordance with determining an unsafe brake pipe operation characteristic. In some non-limiting embodiments or aspects, a brake pipe pressure operation characteristic is determined for verifying a speed operation characteristic.

In some non-limiting embodiments or aspects, the EOT device 104 transmits to the HOT device 102 (e.g., via radio signals, etc.) data pertaining to an amount of pressure in a brake pipe, a position associated with an end of train railcar 16, and/or velocity of the end of train railcar 16. In some non-limiting embodiments or aspects, the EOT device 104 includes a position sensor (e.g., GPS receiver, etc.) to sense location of end of train railcar 16, a motion sensor (e.g., GPS receiver, etc.) to sense velocity of end of train railcar 16, a pressure transducer to monitor brake pipe pressure, a microprocessor unit to control the overall operation of these components, and a transmitter that the microprocessor unit uses to transmit this last end of train railcar 16 data. In the locomotive 12, the HOT device 102 includes a receiver to receive transmissions from the EOT device 104, a primary display, and a microprocessor unit to direct the operation of these components.

In a non-limiting embodiment or aspect, EOT device 104 includes a positioning (e.g., navigation, mapping, etc.) system (e.g., GPS receiver and antenna and magnetic compass for orientation, and/or the like). In some non-limiting embodiments or aspects, the positioning system may be programmed or configured to sense or determine a location, position, or velocity of a portion of the train.

In a non-limiting embodiment or aspect, the EOT device 104 may be programmed to determine or receive a location or position of at least a portion of the train based at least partially on the location or position sensed or determined by the at least one positioning system.

In a non-limiting embodiment or aspect, the EOT device 104 may be programmed or configured to generate or receive an information notification based at least partially on the location or position sensed or determined by the at least one positioning system.

In a non-limiting embodiment or aspect, the HOT device 102 may be programmed or configured to generate or receive an information notification based at least partially on the location or position sensed or determined by the at least one positioning system.

In a non-limiting embodiment or aspect, the EOT device 104 and the HOT device 102 are each equipped with a transceiver (e.g., combination transmitter and receiver, separate transceiver and receiver, etc.). In some non-limiting embodiments or aspects, the EOT device 104 also has an emergency brake valve that is controlled by its microprocessor unit, and the HOT device 102 also includes an emergency toggle switch. In some non-limiting embodiments or aspects, by toggling this switch in an emergency, the train operator can cause the HOT device 102 to transmit an emergency brake radio signal to the EOT device 104. In some non-limiting embodiments or aspects, the EOT device 104 includes a microprocessor unit, for example, to respond to an emergency signal by commanding its emergency brake valve to reduce the pressure in the brake pipe at an emergency rate.

In a non-limiting embodiment or aspect, EOT device 104 (e.g., microprocessor unit, CPU, etc.) responds to a service brake signal by commanding its emergency valve to reduce the brake pipe pressure from the end of train railcar 16 at the same service rate as that ordered by the locomotive brake equipment at the head of the train. In some non-limiting embodiments or aspects, the HOT device 102 also automatically transmits an emergency brake signal when an emergency reduction in has been initiated by brake equipment of the locomotive 12. In some non-limiting embodiments or aspects, the HOT device 102 includes an emergency toggle switch to transmit this emergency brake signal.

In a non-limiting embodiment or aspect, after railcars 14 are coupled to the locomotive(s) 12 to form a train, and before that train is put into service, a train operator must arm (e.g., authorize, etc.) a HOT device 102 in the lead locomotive 12 to communicate with the EOT device 104 on the particular train 10. The arming protocol prevents a HOT device 102 on one train from being erroneously or maliciously used to apply the brakes on another train. To this end, the HOT device 102 includes a thumb wheel switch assembly and a nonvolatile memory in which an identification code that is unique to a particular EOT device 104 may be stored. With that particular EOT device 104 on the end of train railcar 16, the HOT device 102 is only authorized to communicate with the EOT device 104 on the train 10 when the train operator sets the thumb wheel switches to correspond to the EOT device's 104 identification code stored in its memory. The HOT device 102 retains in its memory the identification code for that particular EOT device 104 until armed for a different EOT device 104.

In a non-limiting embodiment or aspect, the HOT device 102 may be programmed or configured to directly or indirectly communicate an information notification to an on-board computer located in or associated with a locomotive 12 of the train 10. For example, the on-board computer communicates (e.g., receives updates, etc.) from HOT device 102 while also in communication with the appropriate braking system and other software or programs to effectively implement train control. The on-board computer receives real-time input from various locomotive control settings or components, including a positioning (e.g., navigation system, mapping system, etc.) system (e.g., a GPS receiver, at least one wheel tachometer/speed sensor, and/or the like). Further, the on-board computer includes or is in communication with a communication device (e.g., a data radio, a communication interface, a communication component, and/or the like), which facilitates communication by or between locomotives 12 and/or the locomotive 12 and some remote server or computer system (e.g., a central controller, a back office server, a remote server, central dispatch, back office PTC components, various wayside devices, such as signal or switch monitors, other on-board computers in the railway system, etc.). Further, this communication may occur wirelessly or in a "hard wired" form, (e.g., over the rails of the track). In addition, the on-board computer includes or is communication with a visual display device, such as the operator's display in the cab of the locomotive 12. This visual display device is used to present information and data to the operator of the train. In one non-limiting embodiment or aspect, the track database includes information about switch locations, track heading changes (e.g., curves) and distance measurements, while the on-board computer receives, from a remote computer (e.g., the back office server, etc.), train consist information (e.g., number of locomotives 12, cars, and total length of the train 10, etc.). Of course, it is envisioned that any type of train management system can be used within the context and scope of the present invention.

In a non-limiting embodiment or aspect, the on-board computer communicates (e.g., receives updates, etc.) from a remote server (e.g., a central controller, a back office server, a remote server, central dispatch, a dispatching system, a communications server, a back office PTC component, various wayside devices, such as signal or switch monitors, other on-board computers in the railway system, etc.). For example, the on-board computer receives updates from a back office (e.g., remote server) based on train integrity conditions.

Figure 2:
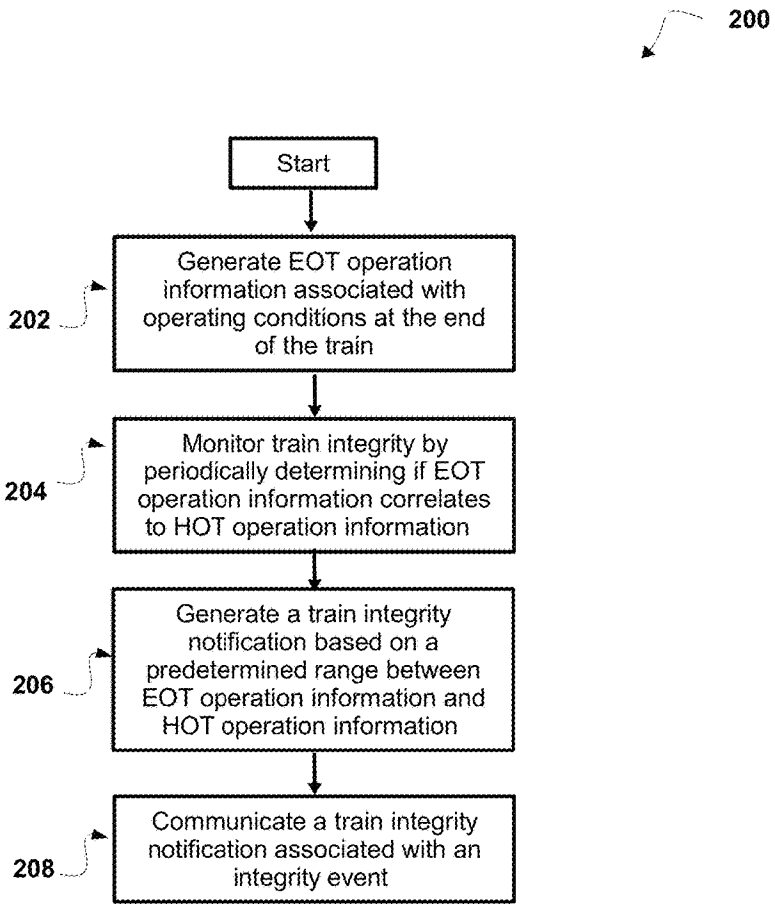
FIG. 2 illustrates a flowchart of a process for verifying train integrity according to a non-limiting embodiment or aspect.

Referring now to FIG. 2, FIG. 2 is a flowchart of a non-limiting embodiment of a process 200 for verifying train integrity in an intra-train communication system between a HOT device 102 in a locomotive 12 and an EOT device 102 in an end of train railcar 16. In some non-limiting embodiments or aspects, one or more of the steps of process 200 are performed (e.g., completely, partially, etc.) in an intra-train communication system including HOT device 102 and/or EOT device 104. In some non-limiting embodiments or aspects, one or more of the steps of process 200 are performed (e.g., completely, partially, etc.) by another device or a group of devices separate from or including HOT device 102, EOT device 104, and/or an on-board computer (e.g., one or more devices of a computer on board the train 10).

As shown in FIG. 2, at step 202, process 200 includes generating EOT operation information associated with operating conditions at the end of the train. For example, in some non-limiting embodiments or aspects, the EOT device 104 generates EOT operation information based on sensor data from one or more sensors located at the end of a train, the EOT operation information associated with one or more operating conditions in at least one railcar 14 at the end of the train 10 (e.g., end of train railcar 16).

In a non-limiting embodiment or aspect, the EOT device 104 generates EOT operation information including a first operational characteristic and second operational characteristic in the train 10 (e.g., a portion of the train 10, one or more portions, etc.).

In a non-limiting embodiment or aspect, the EOT device 104 generates EOT operation information including the first operation characteristic for detecting a false positive associated with the second operation characteristic. For example, in some non-limiting embodiments or aspects, a speed operational characteristic is determined for verifying a brake pipe pressure operation characteristic. For example, in some non-limiting embodiments, HOT device 104 after determining a brake pipe pressure integrity condition, determines a speed operational characteristic to verify train integrity in accordance with determining an unsafe brake pipe operation characteristic. In some non-limiting embodiments or aspects, a brake pipe pressure operation characteristic is determined for verifying a speed operation characteristic.

In a non-limiting embodiment or aspect, process 200 includes generating EOT operation information including at least a first operation characteristic of train speed and a second operation characteristic of brake pipe pressure. For example, in some non-limiting embodiments or aspects, EOT device 104 generates EOT operation information including at least a first operation characteristic of train speed and a second operation characteristic of brake pipe pressure. In some non-limiting embodiments or aspects, EOT device 104 generates EOT operation information including only a first operation characteristic of train speed or brake pipe pressure for verifying train integrity.

In a non-limiting embodiment or aspect, process 200 includes determining a brake pipe pressure in the at least one railcar 14 at the end of a train 10 (e.g., end of train railcar 16) to determine if it correlates to a pressure in a head of a train. For example, in some non-limiting embodiments or aspects, EOT device 104 determines a brake pipe pressure in the at least one railcar 14 at the end of a train 10 and sends it to HOT device 102 to determine if it correlates to a pressure in a head of a train.

In a non-limiting embodiment or aspect, process 200 includes determining a brake pipe pressure associated with and/or in the at least one railcar 14 at an end of a train 10 to determine if it correlates to a brake pipe pressure associated with and/or in a head of a train. For example, in some non-limiting embodiments or aspects, EOT device 104 determines a brake pipe pressure in the at least one railcar 14 at an end of a train 10 (e.g., end of train railcar 16, one or more railcars associated with the end of the train, etc.) and sends it to HOT device 102 to determine if it correlates to a brake pipe pressure at a head of the train (e.g., reported at a head of the train, locomotive 12, etc.). For example, in some non-limiting embodiments or aspects, EOT device 104 determines a speed in the at least one railcar 14 at an end of a train 10 and sends it to HOT device 102 to determine if it correlates to a speed in a head of a train (e.g., are equivalent, within a range, etc.).

In a non-limiting embodiment or aspect, process 200 includes determining a speed associated with and/or in the at least one railcar 14 at an end of a train 10 (e.g., end of train railcar 16) to determine if it correlates to a speed associated with and/or in a head of a train. For example, in some non-limiting embodiments or aspects, EOT device 104 determines a speed in the at least one railcar 14 at an end of a train 10 and sends it to HOT device 102 to determine if it correlates to a speed in a head of a train. For example, in some non-limiting embodiments or aspects, EOT device 104 determines a speed in the at least one railcar 14 at an end of a train 10 and sends it to HOT device 102 to determine if it correlates to a speed in a head of a train (e.g., are equivalent, within a range, etc.).

In a non-limiting embodiment or aspect, process 200 includes determining a speed associated with and/or in the at least one railcar 14 at an end of a train 10, after determining if a brake pipe pressure in the at least one railcar 14 at an end of a train 10 correlates to a pressure in a head of a train 10.

In a non-limiting embodiment or aspect, process 200 includes receiving sensor data from an EOT computer located in or associated with at least one railcar 14 of the train 10 (e.g., end of train railcar 16). For example, in some non-limiting embodiments or aspects, EOT device 104 receives sensor data (e.g., sensor data from one or more sensors located at the end of the train 10, brake pressure data, location data, speed data, etc.) located in or associated with at least one railcar 14 of the train 10. In some non-limiting embodiments or aspects, the sensor data from one or more sensors located at the end of the train 10 are programmed or configured to communicate a status related to train control in at least one railcar 14 at the end of the train 10.

In a non-limiting embodiment or aspect, process 200 includes transmitting, by an EOT device 104, sensor data from an EOT computer located in or associated with at least one railcar 14 of the train 10, the sensor data from one or more sensors located at the end of the train 10, the one or more sensors indicating a status related to train control in at least one railcar 14 at the end of the train 10. For example, in some non-limiting embodiments or aspects, EOT device 104 transmits sensor data (e.g., sensor data from one or more sensors located at the end of the train, etc.) to communicate a status related to train control in at least one railcar 14 at the end of the train 10. For example, in some non-limiting embodiments or aspects, EOT device 104 transmits sensor data to communicate a status related to train control in at least one railcar 14 at the end of the train 10.

As shown in FIG. 2, at step 204, process 200 includes monitoring train integrity by periodically determining if EOT operation information correlates to HOT operation information. For example, in some non-limiting embodiments or aspects, the HOT device 102 is configured to monitor train integrity by periodically determining if the EOT operation information correlates to HOT operation information in a head of the train 10 associated with a status of one or more sensors in the head of the train 10 according to a predetermined range.

In a non-limiting embodiment or aspect, process 200 includes receiving sensor data from an EOT computer located in or associated with at least one railcar 14 at the end of the train 10, the sensor data from one or more sensors located at the end of the train 10, the one or more sensors indicating a status related to train control in at least one railcar 14 at the end of the train 10. For example, in some non-limiting embodiments or aspects, the HOT device 102 is configured to monitor train integrity by periodically receiving sensor data from an EOT computer located in or associated with at least one railcar 14 at the end of the train 10.

In a non-limiting embodiment or aspect, process 200 includes receiving a speed associated with and/or in the at least one railcar 14 at an end of a train 10 to determine if it correlates to a speed associated with and/or in a head of a train 10. For example, in some non-limiting embodiments or aspects, HOT device 102 receives a speed (e.g., determines a GPS speed, etc.). In some non-limiting embodiments or aspects, HOT device 102 receives a speed of the at least one railcar 14 at an end of train 10 to determine if the speed at the end of the train 10 correlates to a speed in a head of a train 10. For example, HOT device 102 receives a speed of the at least one railcar 14 at an end of train 10 to determine if it is equivalent or within a range that includes a speed in a head of the train 10. In some non-limiting embodiments or aspects, the speed of the at least one railcar 14 at an end of the train 10 comprises a speed of the at least one railcar 14 at the end of the train 10 based on a location (e.g., a GPS location, a map location, etc.) of the at least one railcar 14 at the end of the train 10.

In a non-limiting embodiment or aspect, process 200 includes determining a speed associated with and/or in the at least one railcar 14 at an end of a train 10, after determining if a brake pipe pressure in the at least one railcar 14 at an end of a train 10 correlates to a pressure in a head of a train 10. For example, HOT device 102 determines a speed associated with and/or in the at least one railcar 14 at an end of a train 10 after determining if a brake pipe pressure in the at least one railcar 14 at an end of a train 10 correlates to a pressure in a head of a train 10.

In a non-limiting embodiment or aspect, process 200 includes receiving sensor data from an EOT computer located in or associated with at least one railcar 14 at an end of the train 10. For example, in some non-limiting embodiments or aspects, HOT device 102 receives sensor data (e.g., sensor data from one or more sensors located at the end of the train 10, etc.) located in or associated with at least one railcar 14 at the end of the train 10. In some non-limiting embodiments or aspects, the sensor data from one or more sensors located at the end of the train 10 are programmed or configured to communicate a status related to train control in at least one railcar 14 at the end of the train 10.

In a non-limiting embodiment or aspect, process 200 includes receiving sensor data associated with at least one railcar 14 of the train 10. For example, in some non-limiting embodiments or aspects, HOT device 102 receives sensor data (e.g., sensor data from one or more sensors located at the end of the train 10, from an on-board computer, remote computer, wayside computer, etc.) located in or associated with at least one railcar 14 of the train 10. In some non-limiting embodiments or aspects, the sensor data from one or more sensors located at the end of the train 10 are programmed or configured to communicate a status related to train control in at least one railcar 14 at the end of the train 10.

In a non-limiting embodiment or aspect, process 200 includes receiving sensor data from one or more sensors located in or associated with at least one railcar 14 at the head of the train 10.

In a non-limiting embodiment or aspect, process 200 includes monitoring operation information for determining a disconnected portion of the train 10 based on integrity of the train 10 (e.g., brake pressure at both ends of the train 10, speed at both ends of the train 10, etc.). For example, HOT device 102 monitors operation information for determining a disconnected portion of the train 10 based on integrity of the train 10 (e.g., brake pressure at both ends of the train 10, speed at both ends of the train 10, etc.).

In a non-limiting embodiment or aspect, process 200 includes, in response to determining a speed of the disconnected portion of the train 10 within a predetermined range, automatically initiating an emergency application of one or more brakes for stopping a train 10 in the disconnected portion of the train 10. For example, HOT device 102 monitors operation information, and in response to determining a speed of the disconnected portion of the train 10 within a predetermined range, automatically initiates a braking application, such as, for example, through use of the EOT emergency valve for stopping a train 10 in the disconnected portion of the train 10, a penalty brake application, and/or the like.

As shown in FIG. 2, at step 206, process 200 includes generating a train integrity notification based on a predetermined range between EOT operation information and HOT operation information. For example, in some non-limiting embodiments or aspects, the HOT device 102 generates a train integrity notification based at least partially on monitoring the predetermined range between EOT operation information and HOT operation information.

In a non-limiting embodiment or aspect, process 200 includes generating a train integrity notification based on determining a speed of the at least one railcar 14 at the end of the train 10. For example, in some non-limiting embodiments or aspects, HOT device 102 generates a train integrity notification based on determining a speed of the at least one railcar 14 at the end of the train 10.

In a non-limiting embodiment or aspect, process 200 includes generating a train integrity notification based on generating an average speed range over a predetermined period for the at least one railcar 14 at the end of the train 10. In some non-limiting embodiments or aspects, HOT device 102 generates a train integrity notification based on generating an average speed range over a predetermined period for the at least one railcar 14 at the end of the train 10.

In a non-limiting embodiment or aspect, process 200 includes generating a train integrity notification based on an average speed associated with at least one of a railcar 14, a sensor, or a locomotive 12 at a head of the train 10 for a predetermined period. For example, in some non-limiting embodiments or aspects, HOT device 102 generates a train integrity notification while monitoring a train speed based on generating an average speed range over a predetermined period for the at least one railcar 14 at the end of the train 10. For example, a predetermined period may include a period based on one or more of a threshold speed, a geographical range, a time period, and/or the like.

In a non-limiting embodiment or aspect, process 200 includes determining the at least one railcar 14 at the end of the train 10 and the locomotive are within a range over the predetermined period. In some non-limiting embodiments or aspects, HOT device 102 generates a train integrity notification based on monitoring operation information at the end of the train 10 (e.g., at least one railcar 14 at the end of the train 10) and the locomotive 12 to determine a range between the operation information at the head of train 10 and operation information at the end of train 10 over the predetermined period.

In a non-limiting embodiment or aspect, process 200 includes determining the at least one railcar 14 at the end of the train 10 and the locomotive 12 are outside of a range over the predetermined period. In some non-limiting embodiments or aspects, HOT device 102 determines the at least one railcar 14 at the end of the train 10 and the locomotive 12 are outside of a range over the predetermined period.

In a non-limiting embodiment or aspect, process 200 includes determining to disable an emergency brake application based on the train 10 traveling outside (e.g., below, above, non-conforming, etc.) a predetermined threshold speed. In some non-limiting embodiments or aspects, HOT device 102 determines the at least one railcar 14 at the end of the train 10 and the locomotive 12 are outside a range over the predetermined period. In some non-limiting embodiments or aspects, HOT device 102 disables an emergency brake application based on determining the at least one railcar 14 at the end of the train 10 and the locomotive 12 are outside a range over the predetermined period. For example, HOT device 102 disables an emergency brake application based on determining the at least one railcar 14 at the end of the train 10 and the locomotive 12 are traveling at a speed outside a range including the speed of the locomotive 12 over the predetermined period.

In a non-limiting embodiment or aspect, process 200 includes displaying at the head of train, if not within (e.g., outside) a predetermined range, an operator warning associated with verifying an issue with train integrity. For example, in some non-limiting embodiments or aspects, HOT device 102 displays, if not within a predetermined range, an operator warning associated with verifying an issue with train integrity.

In a non-limiting embodiment or aspect, HOT device 102 displays a train integrity notification (e.g., message, signal, alert, etc.) including an operator warning associated with verifying an issue (e.g., brake pipe pressure out of range, speed out of range, etc.) with train integrity while monitoring a train speed based on generating an average speed range over a predetermined period for the at least one railcar 14 at the end of the train 10. For example, in some non-limiting embodiments or aspects, HOT device 102 displays an operator warning for verifying an issue with train integrity. In some non-limiting embodiments or aspects, HOT device 102 displays an operator warning if an operation characteristic is not within a predetermined range.

As shown in FIG. 2, at step 208, process 200 includes communicating a train integrity notification associated with an integrity event. For example, in some non-limiting embodiments or aspects, HOT device 102 directly or indirectly communicates a train integrity notification of an integrity event to an on-board computer located in or associated with at least one locomotive 12 of the train.

In a non-limiting embodiment or aspect, HOT device 102 directly or indirectly communicates a train integrity notification of an integrity event to EOT device 104 located in or associated with at least one railcar 14 at the end of the train 10. In a non-limiting embodiment or aspect, HOT device 102 directly or indirectly communicates a train integrity notification of an integrity event to a remote server associated with a specified entity.

In a non-limiting embodiment or aspect, process 200 includes displaying at the head of the train an operator warning for verifying an issue with train integrity. In a non-limiting embodiment or aspect, HOT device 102 directly or indirectly communicates a train integrity notification of an integrity event to an on-board computer located in or associated with at least one locomotive 12 of the train 10 for displaying an operator warning.

In a non-limiting embodiment or aspect, process 200 includes HOT device 102 directly or indirectly communicating a train integrity notification of an integrity event based on the train 10 traveling outside (e.g., below, above, non-conforming, etc.) a predetermined threshold speed. For example, HOT device 102 communicates a train integrity notification based on an emergency brake application based on determining the at least one railcar 14 at the end of the train 10 and the locomotive 12 are traveling at a speed outside a range including the speed of the locomotive 12 over the predetermined period.

In a non-limiting embodiment or aspect, process 200 includes HOT device 102 directly or indirectly communicates a train integrity notification of an integrity event, if not within (e.g., outside) a predetermined range, an operator warning associated with verifying an issue with train integrity. For example, in some non-limiting embodiments or aspects, HOT device 102 communicates a train integrity event, if not within a predetermined range, associated with verifying an issue with train integrity after determining a brake pipe pressure in the at least one railcar 14 at an end of a train 10 may not correlate to a pressure in a head of a train 10.

In a non-limiting embodiment or aspect, HOT device 102 directly or indirectly communicates a train integrity notification of an integrity event while monitoring a train speed based on generating an average speed range over a predetermined period for the at least one railcar 14 at the end of the train 10.

Figure 3A:
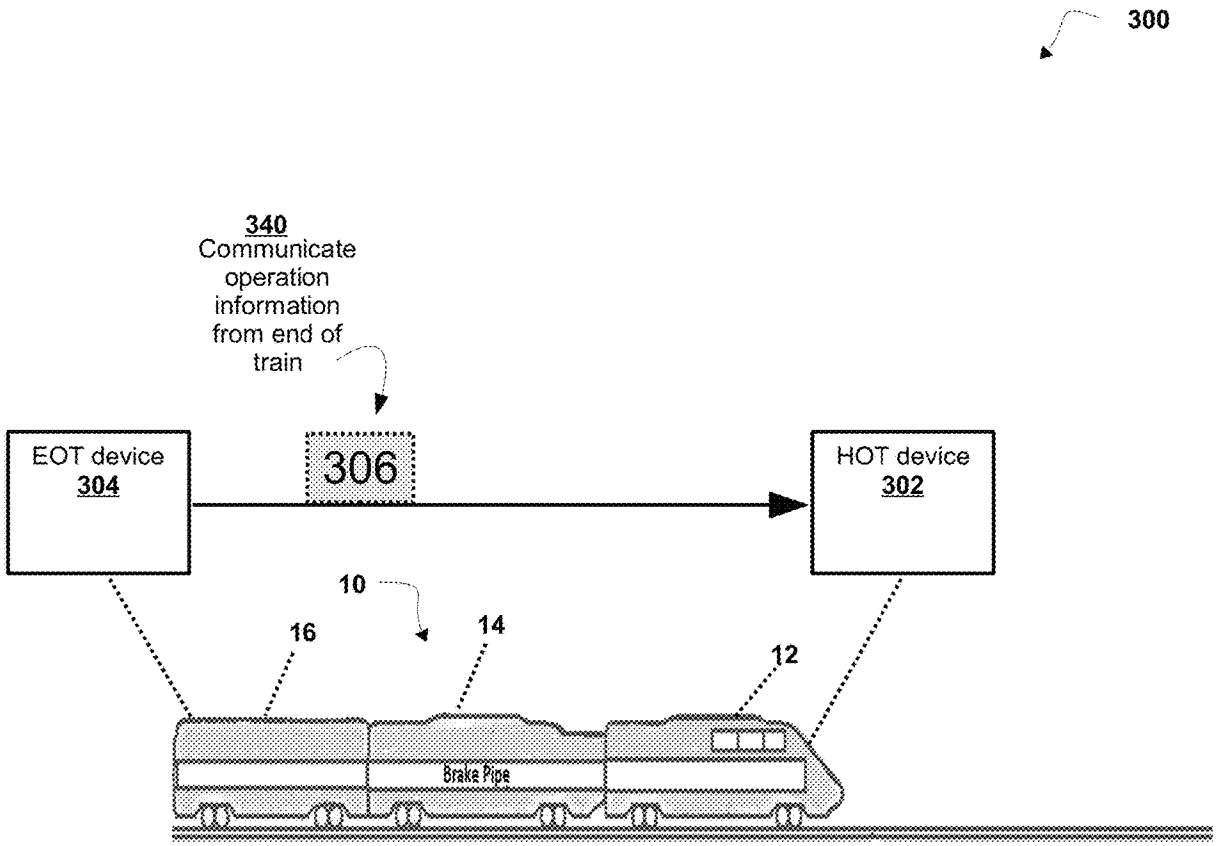
FIGS. 3A-3C illustrate an implementation of a process for verifying train integrity as disclosed herein according to a non-limiting embodiment or aspect.
Figure 3B:
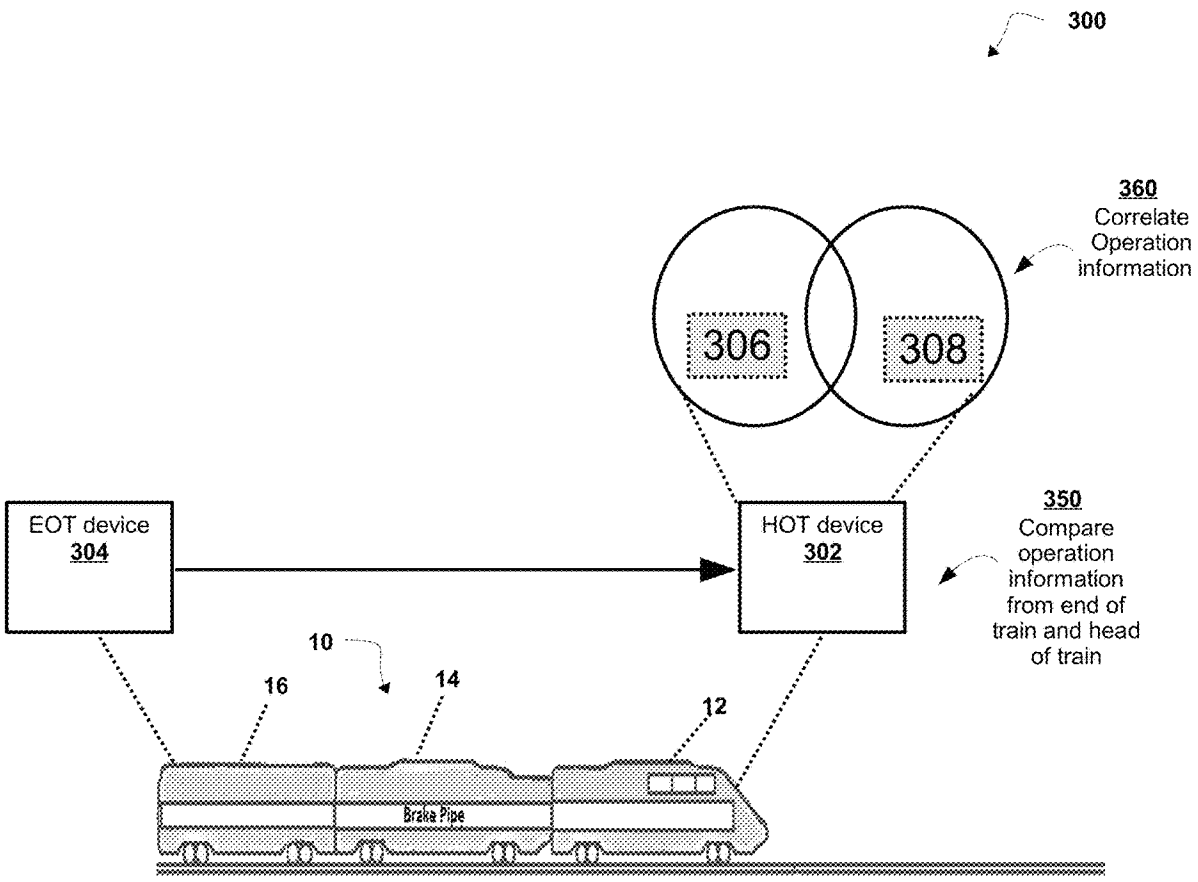
Figure 3C:
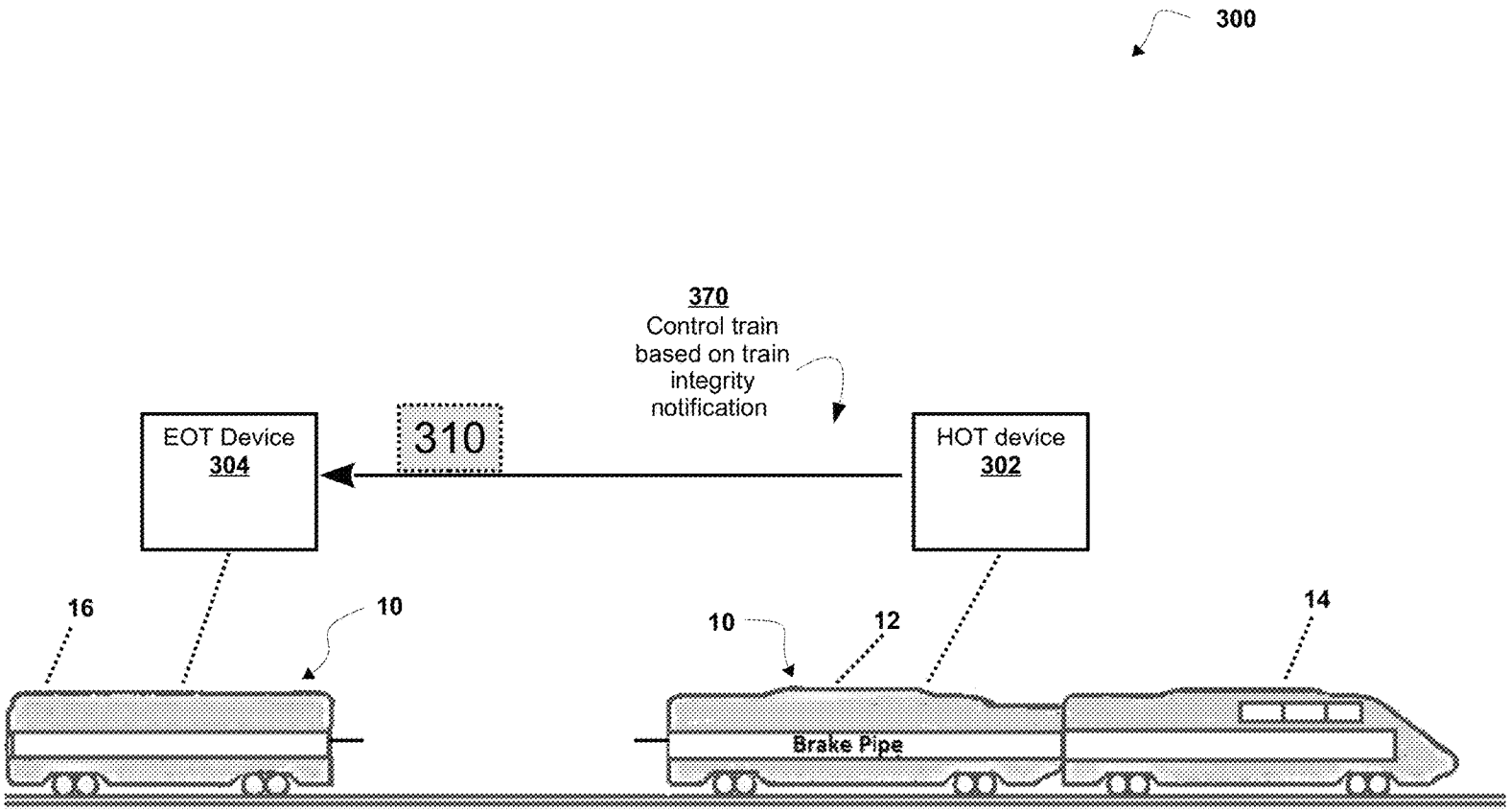

Referring now to FIGS. 3A-3C, FIGS. 3A-3C are diagrams of an overview of a non-limiting embodiment of an implementation 300 relating to a train integrity verification method 300. As shown in FIGS. 3A-3C, implementation 300 may include a train 10, a HOT device 302, and an EOT device 304. In some non-limiting embodiments or aspects, HOT device 302 and EOT device 304 may be the same or similar to HOT device 102 and EOT device 104, respectively.

As shown by reference number 340 in FIG. 3A, implementation 300 includes communicating operation information 306 from an EOT device 304 in an end of train railcar 16 of the train 10. EOT device 304 communicates operation information 306 from an end of the train 10, including a first operational characteristic in the train. The EOT device 304 determines a first operation characteristic (e.g., a speed operation characteristic, a brake pipe pressure characteristic, etc.) based on sensing operation information at the end of the train 10 for verifying train integrity.

As shown by reference number 350 in FIG. 3B, implementation 300 includes comparing operation information from an end of train and a head of train. For example, in some non-limiting embodiments or aspects, HOT device 302 compares operation information from a head of the train 10 and an end of the train 10 for determining integrity of the train (e.g., one or more disconnected portions of the train, etc.) based on operational information (e.g., brake pressure at both ends of the train, speed at both ends of the train, etc.). For example, HOT device 302 monitors (e.g., continually monitors, periodic monitoring, scheduled monitoring, etc.) operation information from a head of the train 10 and an end of the train 10 for detecting a correlation of air pressure or position indicating a problem with integrity of the train (e.g., one or more disconnected portions of the train, etc.) based on operational information (e.g., brake pressure at both ends of the train, speed at both ends of the train, etc.). For example, HOT device 302 monitors operation information for determining a disconnected portion of the train 10 based on integrity of the train 10 (e.g., brake pressure at both ends of the train, speed at both ends of the train, etc.). For example, in some non-limiting embodiments or aspects, the HOT device 302 is configured to monitor train integrity by periodically receiving the EOT operation information 306 and/or the HOT operation information 308.

As further shown by reference number 360 in FIG. 3B, implementation 300 includes correlating EOT operation information 306 and HOT operation information 308. For example, in some non-limiting embodiments or aspects, the HOT device 302 is configured to compare the EOT operation information 306 with the HOT operation information 308 to determine a correlation.

As shown by reference number 370 in FIG. 3C, implementation 300 includes controlling train 10 based on one or more integrity event notifications. For example, in some non-limiting embodiments or aspects, HOT device 302 controls train 10 based on an integrity notification 310 (e.g., one or more integrity event notifications, etc.). In some non-limiting embodiments or aspects, HOT device 302 controls an emergency stop from both ends of the train 10 simultaneously in an emergency application of the brakes. This is useful in the event that the train's brake line is blocked (e.g., a blockage, an unopened valve, etc.) and preventing the dumping of the air pressure. Such a situation could be dangerous, as stopping distance increases with fewer functioning brakes. Dumping the brake line pressure from both the front and rear of the train simultaneously ensures that the entire train applies all of its brakes in emergency applications.

In a non-limiting embodiment or aspect, the train integrity verification systems and methods may further include a web portal. The web portal may be an interface through which operators may monitor train integrity operation information and train integrity verification warnings. By way of a non-limiting embodiment or aspect, the web portal may display and report operational and integrity alerts.

In a non-limiting embodiment or aspect, the train integrity verification systems and methods may further include a computer application, such as a smart phone application, through which users may receive push integrity notifications for verifying integrity of the train 10 (e.g., an alert, a status, a train integrity report, etc.). By way of a non-limiting embodiment or aspect, the push notifications may depend on the role of the users, such as whether the users are associated with the railroad for the train 10 or is associated with another specified entity, such as a first responder.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

What is claimed is:

1. A method comprising:

determining end of train (EOT) operation information based on first sensor data from first sensors located at an end of a train, the EOT operation information including a first moving speed of first railcars at the end of the train and a first brake pipe pressure measured in the first railcars at the end of the train;

determining head of train (HOT) operation information based on second sensor data from second sensors located at a head of the train, the HOT operation information including a second moving speed of a locomotive or one or more second railcars at a head of the train and a second brake pipe pressure measured in the locomotive or the one or more second railcars at the head of the train;

monitoring, at an on-board computer having one or more processors, train integrity by determining whether the EOT operation information correlates with the HOT operation information, the train integrity determined by comparing the first moving speed with the second moving speed and, responsive to the first moving speed and the second moving speed not being within a designated range of each other, comparing the first brake pipe pressure with a predicted brake pipe pressure that is determined as a function of time and the second brake pipe pressure;

responsive to determining that the EOT operation information is not correlated with the HOT operation information, generating, by the on-board computer, an integrity notification based on the train integrity that is monitored; and responsive to generating the integrity notification, communicating, by at least one communication device, a notification of an integrity event to one or more of: the on-board computer located in or associated with at the locomotive, an EOT device located in or associated with the one or more first railcars, or a remote server.

2. The method of claim 1, further comprising:

determining a disconnected portion of the train based on comparing the first moving speed with the second moving speed and the first moving speed and the second moving speed not being within the designated range of each other; and automatically initiating an emergency application of one or more brakes in a first portion of the train that includes the head of the train responsive to determining the disconnected portion of the train for stopping the disconnected portion of the train.

3. The method of claim 1, further comprising:

displaying an operator warning responsive to determining that the EOT operation information is not correlated with the HOT operation information.

4. The method of claim 1, further comprising:

communicating, using an EOT device, third sensor data associated with the one or more first railcars at the end of the train, the third sensor data from the one or more first sensors located at the end of the train, the one or more third sensors indicating a status related to train control in the one or more first railcars at the end of the train.

5. The method of claim 1, wherein the first brake pipe pressure is compared with the predicted brake pipe pressure responsive to the first moving speed and the second moving speed not being within the designated range of each other for detecting a false positive associated with the integrity event.

6. The method of claim 1, wherein the predicted brake pipe pressure is based on a length of the train.

7. The method of claim 1, further comprising:

stopping the monitoring of the train integrity by determining whether the EOT operation information correlates with the HOT operation information responsive to the second moving speed decreasing below a designated threshold.

8. The method of claim 1, wherein the predicted brake pipe pressure is lower than the first brake pipe pressure.

9. A system comprising:

one or more processors configured to compare a first moving speed of a head of a train (HOT) with a second moving speed of an end of the train (EOT), the one or more processors configured to subsequently determine a first brake pipe pressure of the EOT and predict a predicted brake pipe pressure of the EOT as a function of a second brake pipe pressure measured at the HOT and a length of the train responsive to the first moving speed and the second moving speed not being within a first designated range of each other, the one or more processors configured to compare the first brake pipe pressure of the EOT with the predicted brake pipe pressure, the one or more processors configured to determine that the train has separated into separate portions responsive to both (a) the first moving speed and the second moving speed not being within the first designated range of each other and (b) the predicted brake pipe pressure and the first brake pipe pressure not being within a second designated range of each other.

10. The system of claim 9, wherein the predicted brake pipe pressure is lower than the second brake pipe pressure.

11. The system of claim 9, wherein the one or more processors are configured to determine the first moving speed of the HOT as a first average of speeds at which the HOT is moving during a predetermine period of time, the one or more processors configured to determine the second moving speed of the EOT as a second average of speeds at which the EOT is moving during the predetermined period of time.

12. The system of claim 9, wherein the one or more processors are configured to stop comparing the first moving speed with the second moving speed and stop comparing the first brake pipe pressure with the predicted brake pipe pressure responsive to the first moving speed decreasing below a designated speed threshold.

13. The system of claim 9, wherein the one or more processors are configured to initiate a brake application of the portion of the train that includes the HOT responsive to determining that the train has separated into the separate portions.

14. A method comprising:

determining a first moving speed of a head of a train (HOT) and a second moving speed of an end of the train (EOT);

comparing the first moving speed with the second moving speed;

determining a first brake pipe pressure of the EOT;

responsive to the first moving speed and the second moving speed not being within a first designated range of each other, predicting a predicted brake pipe pressure of the EOT as a function of a second brake pipe pressure measured at the HOT and a length of the train;

comparing the first brake pipe pressure of the EOT with the predicted brake pipe pressure; and determining that the train has separated into separate portions responsive to both (a) the first moving speed and the second moving speed not being within the first designated range of each other and (b) the predicted brake pipe pressure and the first brake pipe pressure not being within a second designated range of each other.

15. The method of claim 14, wherein the predicted brake pipe pressure is lower than the second brake pipe pressure.

16. The method of claim 14, wherein the first moving speed of the HOT is determined as a first average of speeds at which the HOT is moving during a predetermine period of time, and the second moving speed of the EOT is determined as a second average of speeds at which the EOT is moving during the predetermined period of time.

17. The method of claim 14, further comprising:

stopping the comparing the first moving speed with the second moving speed and stopping the comparing of the first brake pipe pressure with the predicted brake pipe pressure responsive to the first moving speed decreasing below a designated speed threshold.

18. The method of claim 14, further comprising:

initiating a brake application of the portion of the train that includes the HOT responsive to determining that the train has separated into the separate portions.

* * * * *